US006098640A

United States Patent [19]

Nguyen et al.

[11] Patent Number: 6,098,640

[45] **Date of Patent: *Aug. 8, 2000**

[54] PRESSURIZED CLEANING OF DEVELOPER DISPENSER NOZZLES

[75] Inventors: Niem D. Nguyen; Loc Vo, both of San Jose, Calif.

[73] Assignee: Advanced Micro Devices, Inc., Sunnyvale, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/827,706

[22] Filed: Apr. 8, 1997

[51] Int. Cl.[7] ..... B08B 5/00

[52] U.S. Cl. ..... 134/22.1; 134/22.12; 134/22.18; 134/37; 134/102.2; 15/406

[58] Field of Search ..... 134/22.1, 22.12, 134/22.11, 22.14, 22.18, 22.19, 24, 36, 37, 102.2, 166 R, 169 R; 15/406

[56] References Cited

U.S. PATENT DOCUMENTS

| | | | |
|---|---|---|---|
| 2,076,262 | 4/1937 | Black | 134/102.2 |
| 3,131,418 | 5/1964 | Morningstar | 15/406 |
| 3,232,482 | 2/1966 | Stock et al. | 134/102.2 |
| 3,665,547 | 5/1972 | Boylan | 15/406 |
| 3,915,739 | 10/1975 | Maahs et al. | 134/22.18 |
| 4,063,317 | 12/1977 | Santore | 15/406 |
| 4,170,489 | 10/1979 | Magnus et al. | 134/22.12 |
| 4,526,623 | 7/1985 | Ishii et al. | 134/22.12 |
| 4,995,915 | 2/1991 | Sewell et al. | 134/22.12 |
| 5,485,857 | 1/1996 | Amundsen | 134/102.2 |

FOREIGN PATENT DOCUMENTS

| | | | |
|---|---|---|---|
| 1386047 | 3/1975 | United Kingdom | 15/406 |

*Primary Examiner*—Randy Gulakowski
*Assistant Examiner*—Saeed Chaudhry

[57] ABSTRACT

Clogged openings of a developer dispenser nozzle are unclogged utilizing a pressurized gas, such as nitrogen. An embodiment includes passing a solution of alcohol and water under gas pressure through the developer dispenser nozzle to unclog the nozzle openings.

17 Claims, 2 Drawing Sheets

PRESSURIZED CLEANING OF DEVELOPER DISPENSER NOZZLES

TECHNICAL FIELD

The present invention relates to cleaning or unclogging the openings of a photoresist developer dispenser nozzle. The present invention is particularly applicable in improving the efficiency of photolithographic techniques employing positive working photoresist materials.

BACKGROUND ART

Conventional practices during various phases in the manufacture of semiconductor devices involve the use of photolithographic techniques. For example, fine patterns and openings are typically formed by photolithographic techniques wherein a photoresist material, such as a positive working photoresist material, is deposited, imagewise exposed, and developed to form a pattern or opening. Etching is then conducted through the opening or pattern to form a corresponding opening or pattern in the underlying layer. Typically, development of the exposed photoresist material is conducted by passing a liquid developer solution or dispersion, suitably selected for the particular photoresist material, through a photoresist developer dispenser nozzle which comprises an inlet and an outlet having a plurality of very fine openings. One such type of spray nozzle is known as an E2 nozzle and is commercially available in combination with a TEL developer system marketed by TEA of Austin, Tex., and manufactured by TEL of Tokyo, Japan.

A problem which typically occurs during photolithographic processing in the semiconductor industry, particularly when developing a positive working photoresist, is frequent clogging of the fine openings of the photoresist developer dispenser nozzle, presumably from developer residue. Such a developer dispenser nozzle clogging problem becomes particularly acute as photolithographic techniques strive to satisfy the ever-increasing demands for miniaturization associated with ultra-large scale integration with increasingly smaller feature sizes.

A conventional approach to the clogging problem associated with dispenser spray nozzles comprises manually removing the nozzle from the developer apparatus and soaking the nozzle in a solution of the type recommended by the developer apparatus manufacturer, such as a solution of isopropyl alcohol and water. This conventional approach to the developer dispenser nozzle clogging problem has not been particularly effective, in that the developer residue which clogs the fine openings is extremely difficult to remove completely. In addition, the conventional manual approach to the developer dispenser nozzle clogging problem is extremely time consuming, normally requiring about two hours, thereby significantly decreasing production throughput. Another disadvantage attendant upon the conventional remedy of manually removing the nozzle from the developer apparatus for cleaning is the necessity to replace the nozzle in a precise position for continued operation in manufacturing integrated circuits.

There exists a need for an apparatus for efficiently cleaning or unclogging a photoresist developer dispenser nozzle. There also exists a need for a rapid, cost-efficient and effective method for cleaning or unclogging the openings of a photoresist developer dispenser nozzle.

DISCLOSURE OF THE INVENTION

An object of the present invention is an apparatus for unclogging the openings of a photoresist developer dispenser nozzle.

Another object of the present invention is a modified photoresist developer apparatus comprising a cleaning system for efficiently unclogging the photoresist developer dispenser nozzle.

A further object of the present invention is a method for efficiently unclogging the openings of a photoresist developer dispenser nozzle.

According to the present invention, the foregoing and other objects are achieved in part by an apparatus comprising: a photoresist developer dispenser nozzle having an inlet and an outlet comprising a plurality of openings; and a pressure cleaning system releasibly connected to the nozzle inlet for unclogging one or more of the openings.

Another aspect of the present invention is an apparatus comprising: a photoresist applicator for depositing a fluid for developing a positive working photoresist; a developer applicator for depositing a fluid for developing a positive working photoresist through a developer dispenser nozzle having an inlet and an outlet comprising a plurality of openings; and a pressure cleaning system releasibly connected to the nozzle inlet for unclogging one or more of the openings.

Another aspect of the present invention is a method of unclogging a developer dispenser nozzle having an inlet and an outlet comprising a plurality of openings, which method comprises flowing a gas under pressure into the inlet through the outlet to unclog at least one of the openings.

A further object of the present invention is a method of unclogging a developer dispenser nozzle having an inlet and an outlet comprising a plurality of openings, which method comprises: connecting a first end of a first gas line to an opening of a container filled with a solution of water and an alcohol; releasibly connecting a second end of the first gas line to the dispenser nozzle inlet; connecting a first end of a second gas line to the container opening; releasibly connecting a second end of the second gas line to a source of pressurized gas; flowing pressurized gas through the second gas line into the container; a n d flowing the solution under pressure of the gas into the inlet through the developer dispenser outlet to unclog at least one of the openings.

Additional objects and advantages of the present invention will become readily apparent to those skilled in the art from the following detailed description, wherein only the preferred embodiment of the invention is shown and described, simply by way of illustration of the best mode contemplated for carrying out the invention. As will be realized, the invention is capable of other and different embodiments, and its details are capable of modifications in various obvious respects, all without departing from the invention. Accordingly, the drawings and description are to be regarded as illustrative in nature, and not as restrictive.

BEST MODE FOR CARRYING OUT THE INVENTION

Figure 1:
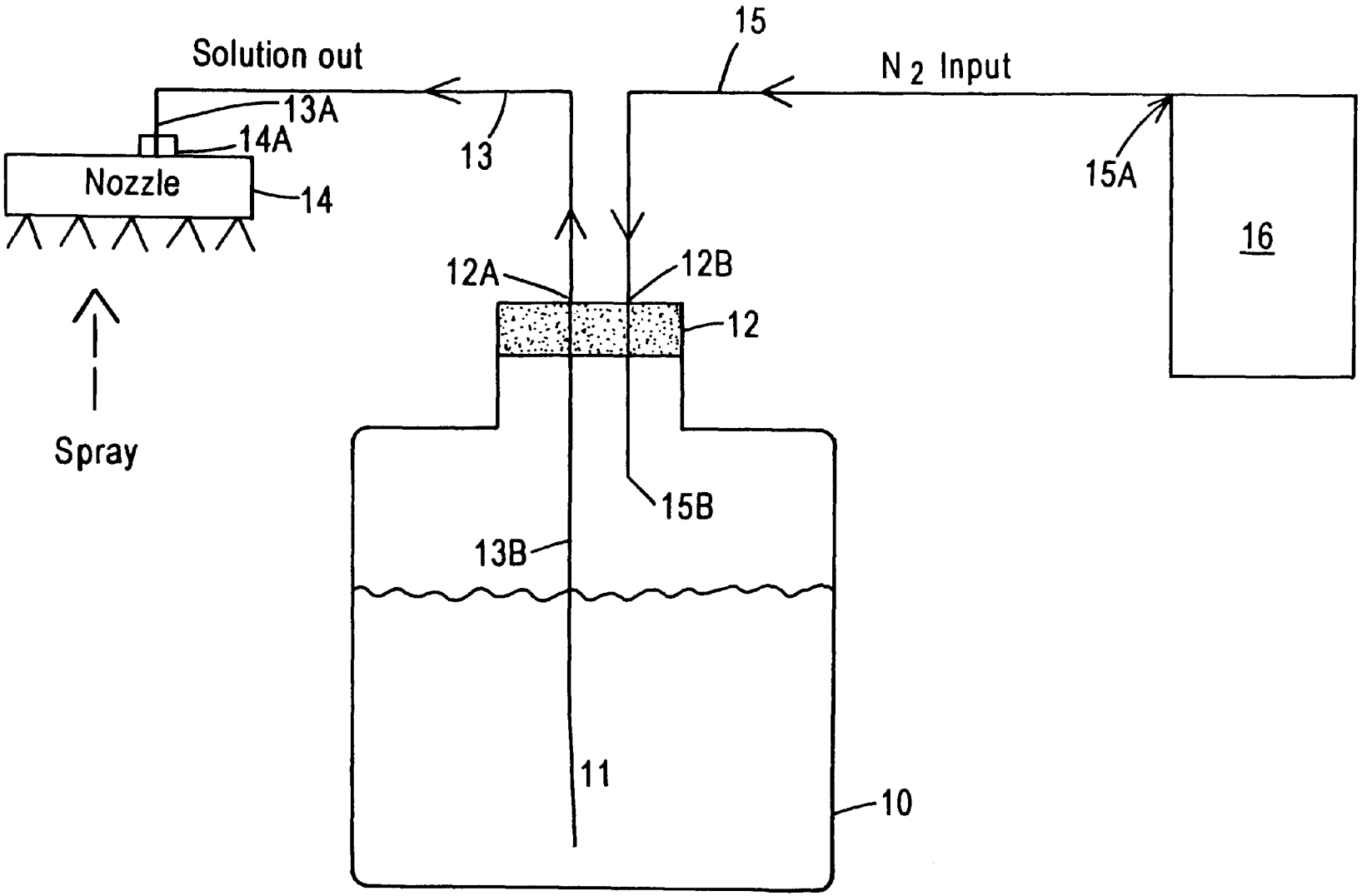
FIG. 1 illustrates a pressure cleaning apparatus according to an embodiment of the present invention.

The present invention addresses and solves the problem and adverse consequences of clogging the openings of a photoresist developer dispenser nozzle which frequently occurs during photolithographic processing in various stages during the manufacture of semiconductor devices, particularly in photolithographic processing involving positive working photoresist materials. The present invention solves the developer dispenser clogging problem in an efficient, cost-effective manner in an extremely short period of time vis-a-vis conventional manual remedies involving removal of the dispenser nozzle from the photoresist developer apparatus and soaking the nozzle in a solvent.

The present invention stems from the discovery that the developer dispenser nozzle clogging problem is due, to a considerable extent, to the accumulation of very fine relatively water and/or alcohol insoluble particles, e.g., particles of about 1 to about 5 microns. Accordingly, the conventional approach to the developer dispenser nozzle clogging problem comprising soaking the removed nozzle in a water-alcohol solution is not particularly effective in removing such accumulated, relatively insoluble extremely fine particles which clog the nozzle openings.

In accordance with the present invention, pressure is employed to dislodge the particles clogging the developer dispenser nozzle openings in a rapid and efficient manner. In accordance with an embodiment of the present invention, a pressurized gas, preferably a gas which is inert to the developer system, such as nitrogen gas, is forced through the openings of the developer dispenser nozzle to dislodge extremely fine particles of developer residue blocking or clogging the openings of the developer dispenser nozzle. In an aspect of this embodiment, the developer inlet to the developer dispenser nozzle is disconnected and a gas line releasibly connected to the nozzle inlet. The other end of the gas line can be connected directly to a source of pressurized gas, such as nitrogen. A valve can be provided in the line, e.g., proximate the pressurized gas source, or on the gas source, to control the flow rate of the gas through the nozzle.

In another aspect of this embodiment of the present invention found particularly effective, a liquid is flowed through the developer dispenser nozzle openings under the force of pressurized gas to dislodge the extremely fine particles clogging the openings. The liquid employed for nozzle cleaning is desirably chemically inert with respect to the developer to avoid subsequent contamination during development of an exposed photoresist layer. It has also been found effective to employ a water soluble liquid together with water in a solution which is forced through the dispenser nozzle openings under gas pressure. In an aspect of this embodiment, a solution of water and an alcohol, such as isopropyl alcohol, is forced into the developer dispenser nozzle inlet and through the outlet openings by nitrogen gas to dislodge particles clogging the openings.

The embodiments of the present invention can be implemented in a simplified and cost-effective manner with minimal additional equipment. For example, a supply of pressurized nitrogen gas is usually available in a photolithographic area for use in connection with the application and development of a photoresist material during photolithographic processing. Typically, such existing sources of pressurized nitrogen comprise a plurality of readily available gas outlets.

In another embodiment of the present invention, a container, such as about one liquid gallon in capacity, is filled with a solution of water and an alcohol, such as isopropyl alcohol. One of ordinary skill in the art can easily optimize the ratio of water to alcohol given the objective of the present invention. For example, it has been found suitable to employ a volume ratio of water to alcohol of about 4:1 to 1:1, such as a ratio of water to alcohol of about 3:1. A stopper, such as a conventional elastomeric or rubber stopper, can be employed with two holes formed therethrough. A first gas line, such as a conventional gas tubing, e.g., ¼ inch Teflon tubing, is provided having a first end for communication with the container, as through one of the openings in the stopper. The second end of the first gas line is provided with a releasable coupling portion which releasibly mates with a coupling portion provided on the dispenser nozzle inlet. Such releasible couplings can comprise any of conventional quick release couplings, or can comprise conventional screw couplings. A first end of second gas line is then inserted through the other hole in the stopper and the second end of the second gas line is releasibly connected to the outlet of the pressurized gas source also employing a conventional quick release coupling. A valve can be provided for controlling the gas flow rate.

The stopper with first ends of the first and second gas lines therein is then inserted to the container opening. Pressurized gas is then flowed from the pressurized gas source into the container, thereby forcing the solution of water and alcohol out of the container along with pressurized gas into the developer dispenser nozzle inlet and through the outlet openings to dislodge particulate material clogging at least one of the openings. One having ordinary skill in the art could easily optimize the gas flow rate to achieve the developer dispenser nozzle cleaning objective of the present invention. For example, it has been found that a gas flow rate of about 0.5 $kg/cm^2$ to about 1.5 $kg/cm^2$ is generally effective.

The rapid effectiveness of the present invention becomes apparent when the liquid flows out of the developer dispenser nozzle openings at a uniform flow rate. The present invention enables effective cleaning or unclogging of a developer dispenser nozzle in about one half hour. Advantageously, the embodiments of the present invention do not require removal of the developer dispenser nozzle from the developer apparatus for cleaning and, hence, do not require time consuming accurate repositioning of the nozzle for continued development in forming highly integrated circuit patterns.

The container can be affixed in any convenient manner to the developer apparatus and the gas lines connected in any convenient conventional manner to provide quick accessibility. In another embodiment of the present invention, the container, stopper and gas lines with releasibly coupling portions can be provided as a portable system for use with a plurality of developer apparatus and/or for convenient storage between cleanings.

Thus, an apparatus in accordance with an embodiment of the present invention can comprise a gas line with releasible coupling portions for connecting a pressurized gas source and a developer dispenser nozzle inlet. An apparatus in accordance with another embodiment of the present invention comprises a container connected to one end of first gas line which in turn is releasibly connected at its other end to a developer dispenser nozzle inlet. The container is also connected to one end of a second gas line which is releasibly connected at its other end to a pressurized gas source. In an aspect of this embodiment, a container having a single opening can be employed with a stopper, having two holes, inserted into the container opening. One stopper hole accommodates one end of the gas line releasibly connected at its other end to the developer dispenser nozzle, while the other hole accommodates one end of the second gas line releasibly connected at its other end to the pressurized gas source.

An embodiment of the present invention is illustrated in FIG. 1 and comprises container 10, which can be provided in any suitable size in light of practical considerations of space and handling. Container 10 is filled with a liquid 11 such as a solution of distilled water and an alcohol, e.g., isopropyl alcohol. It has been found particularly effective to employ a solution of distilled water and 100% isopropyl alcohol in a volume ratio of distilled water to 100% isopropyl alcohol of about 3:1. A stopper 12 is inserted in the opening of container 10. A first gas line 13 having a first end 13A is releasibly connected to the inlet 14A of photoresist developer dispenser nozzle 14 which comprises part of a photoresist developer apparatus. As photoresist developer apparatuses are conventional, they are not described or depicted herein to facilitate appreciation and understanding of the thrust of the present invention. A second end 13B of first gas line 13 is passed through a first opening 12A in stopper 12. A second gas line 15 is releasibly connected to a source of pressurized gas 16 at a first end 15A. Second end 15B of second gas line 15 is passed through a second opening 12B in stopper 12 and into container 11.

Advantageously, the components employed in practicing the present invention are inexpensive and readily available. For example, a pressurized nitrogen source is usually available as part of a conventional photolithographic processing assembly. Container 11 can be a glass bottle or made of a plastic or metallic material. Lines 13 and 14 can comprise typical tubing employed for gas systems, such as one-quarter inch plastic tubing, e.g., Teflon tubing. Couplings for releasibly connecting the gas lines to the pressurized gas source and developer dispenser nozzle inlet can comprise any of conventional quick disconnect couplings, or even screw couplings. Stopper 12 can comprise any elastomeric material, such as an ordinary rubber stopper with holes provided therein. Accordingly, the present invention can be implemented in a cost-effective, efficient manner, and can be advantageously provided as a portable system or affixed to a photoresist developer apparatus.

Conveniently, the effectiveness of the present invention can be readily determined by observing the continuity of the fluid flowing out of the openings of the dispenser nozzle after a short period of pressurized cleaning. For example, after approximately 30 minutes of pressurized cleaning in accordance with the present invention employing pressurized nitrogen gas and a solution of distilled water and isopropyl alcohol, the spray emitting from the nozzle openings will appear uniform.

Figure 2:
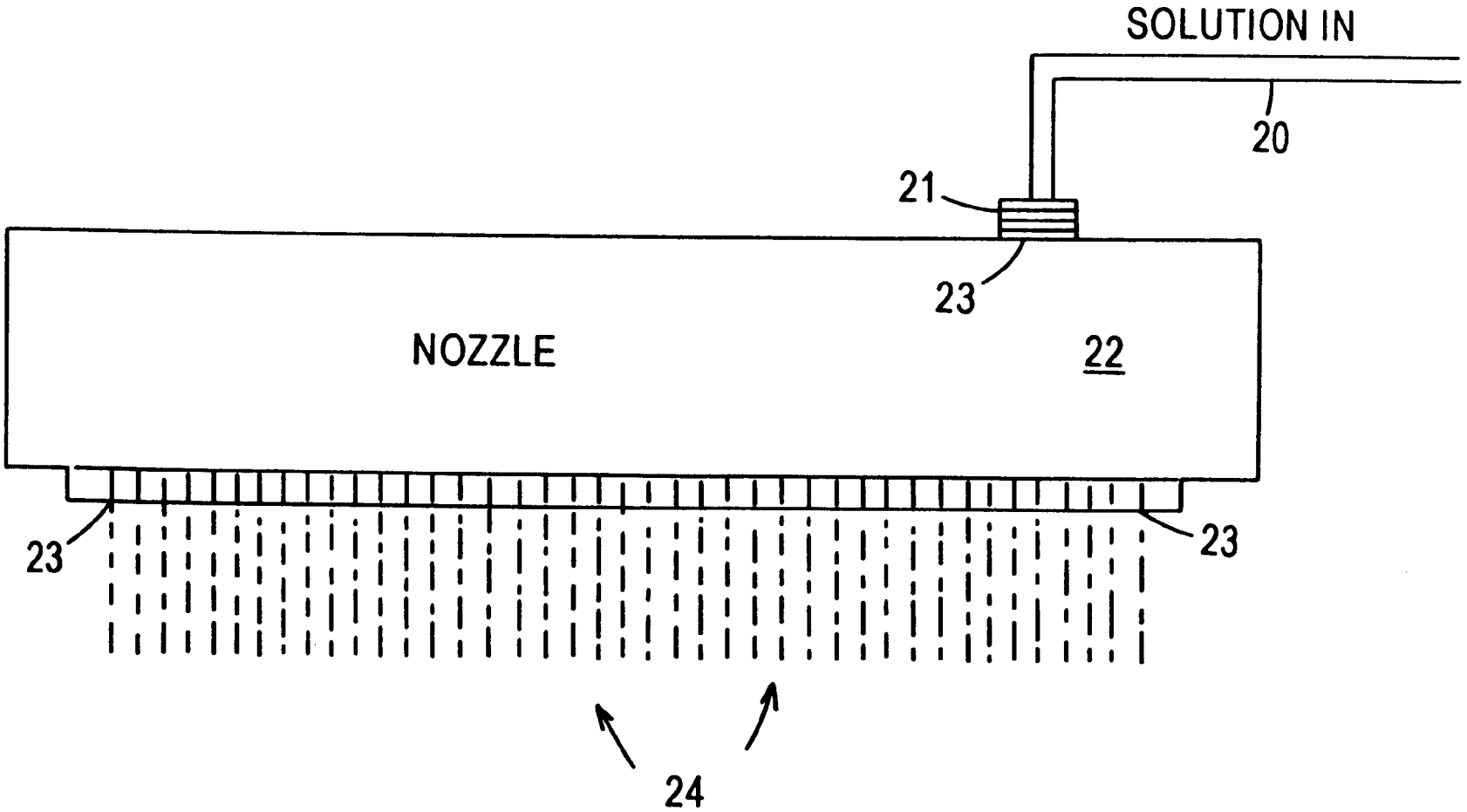
FIG. 2 illustrates the effectiveness of the present invention in unclogging a photoresist developer dispenser nozzle.

Adverting to FIG. 2, first gas line 20 is releasible connected to developer dispenser nozzle 22 via quick release coupling 21. A solution of distilled water and isopropyl alcohol is flowed under nitrogen gas pressure through line 20, inlet 21 of developer dispenser nozzle 22 and through nozzle openings 23. After a short period of time, the spray emitting from nozzle openings 23 appears uniform as indicated by reference numeral 24. At this point, none of the developer dispenser nozzle openings are obstructed or clogged by particulate developer residue.

The present invention involving pressurized cleaning of a photoresist developer dispenser nozzle is extremely efficient, rapid, inexpensive, and results in fewer defects during semiconductor manufacturing. The present invention advantageously avoids the time-consuming manual removal of a photoresist developer dispenser nozzle and solvent cleaning thereof. The present invention further advantageously involves very few components, each of which is readily available and inexpensive. Thus, the present invention increases efficiency, reduces manufacturing cost, and improves the reliability of the resulting semiconductor devices. The present invention enjoys utility in various stages during the manufacture of semiconductor devices wherein the photolithographic processing is conducted, particularly in developing a positive working photoresist. The present invention can be advantageously employed with or incorporated on any of various conventional photoresist developing apparatuses employed in the manufacture of semiconductor devices.

In the previous descriptions, numerous specific details are set forth, such as specific materials, structures, chemicals, processes, etc., in order to provide a thorough understanding of the present invention. However, as one having ordinary skill in the art would recognize, the present invention ca be practiced without resorting to the details specifically set forth. In other instances, well known processing structures have not been described in detail in order not to unnecessarily obscure the present invention.

Only the preferred embodiment of the invention and but a few examples of its versatility are shown and described in the present disclosure. It is to be understood that the invention is capable of use in various other combinations and environments and is capable of changes or modifications within the scope of the inventive concept as expressed herein.

What is claimed is:

1. A method of unclogging a photoresist developer dispenser nozzle containing a photoresist developer for use in manufacturing a semiconductor device, the photoresist dispenser nozzle having an inlet and an outlet comprising plurality of openings, which method comprises flowing a gas under pressure into the inlet through the outlet to unclog at least one of the openings, wherein the developer dispenser nozzle does not require removal from a developer apparatus.

2. The method according to claim 1, wherein the gas comprises nitrogen.

3. The method according to claim 1, comprising flowing a liquid into the inlet through the outlet with the gas under pressure.

4. The method according to claim 3, wherein the liquid comprises an alcohol.

5. The method according to claim 4, wherein the liquid comprises a solution of water and an alcohol.

6. The method according to claim 5, wherein the alcohol comprises isopropyl alcohol.

7. The method according to claim 6, wherein the volume ratio of water to alcohol is about 4:1 to about 1:1.

8. The method according to claim 5, wherein the gas flow rate is about 0.5 $kg/cm^2$ to about 1.5 $kg/cm^2$.

9. The method according to claim 1, comprising:

releasibly connecting a gas line to a source of pressurized gas; and releasibly connecting a gas line to the dispenser nozzle inlet.

10. The method according to claim 1, comprising:

connecting a first end of a first gas line to an opening of a container with a solution of water and an alcohol therein;

releasibly connecting a second end of the first gas line to the dispenser nozzle inlet;

connecting a first end of a second gas line to the container opening;

releasibly connecting a second end of the second gas line to a source of pressurized gas;

flowing pressurized gas through the second gas line into the container; and flowing the solution under pressure of the gas into the inlet through the developer dispenser nozzle outlet to unclog at least one of the openings.

11. The method according to claim 10, comprising flowing the solution through the developer dispenser nozzle until the solution flows out of the nozzle at a substantially uniform flow rate.

12. The method according to claim 10, wherein the gas comprises nitrogen.

13. The method according to claim 12, wherein the alcohol comprises isopropyl alcohol.

14. The method according to claim 10, comprising:

inserting the second end of each of the first and second gas lines into first and second holes of a stopper; and inserting the stopper into the container opening.

15. The method according to claim 14, comprising inserting the stopper into the container opening so that the first end of the first gas line extends into the solution in the container.

16. The method according to claim 3, wherein the liquid is substantially water soluble.

17. The method according to claim 3, comprising flowing a positive working photoresist developer through the developer dispenser nozzle after unclogging the nozzle, wherein the fluid employed during unclogging is non-reactive with respect to the developer.

* * * * *